US007420435B2

(12) United States Patent
Kawanami

(10) Patent No.: US 7,420,435 B2
(45) Date of Patent: Sep. 2, 2008

(54) NON-RECIPROCAL CIRCUIT ELEMENT, METHOD FOR MANUFACTURING THE SAME, AND COMMUNICATION DEVICE

(75) Inventor: Takashi Kawanami, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/757,576

(22) Filed: Jun. 4, 2007

(65) Prior Publication Data

US 2007/0236304 A1 Oct. 11, 2007

Related U.S. Application Data

(63) Continuation of application No. PCT/JP2006/319568, filed on Sep. 29, 2006.

(30) Foreign Application Priority Data

Oct. 21, 2005 (JP) ..... 2005-307724

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

2002/0079981 A1 6/2002 Tanaka
2004/0263278 A1 12/2004 Hino

FOREIGN PATENT DOCUMENTS

JP 2002-076711 A 3/2002
JP 2005-020195 A 1/2005

OTHER PUBLICATIONS

Official Communication for PCT Application No. PCT/JP2006/319568; mailed on Dec. 19, 2006.

*Primary Examiner*—Stephen E Jones
(74) *Attorney, Agent, or Firm*—Keating & Bennett, LLP

(57) ABSTRACT

A non-reciprocal circuit element is equipped with a ferrite-magnet assembly which includes a pair of permanent magnets and a ferrite sandwiched between the permanent magnets. A first center electrode and a second center electrode defined by conducting films are provided on principal surfaces of the ferrite, such that the first center electrode and the second center electrode are insulated from each other and intersect each other. The permanent magnets have principal surfaces having substantially the same shape as the principal surfaces of the ferrite. The ferrite has upper and lower surfaces provided with recesses. The recesses have a conductor material embedded therein, whereby intermediate electrodes and connector electrodes are provided.

16 Claims, 7 Drawing Sheets

NON-RECIPROCAL CIRCUIT ELEMENT, METHOD FOR MANUFACTURING THE SAME, AND COMMUNICATION DEVICE

BACKGROUND OF THE INVENTION

1. Field of the Invention

The present invention relates to non-reciprocal circuit elements, and particularly, to a non-reciprocal circuit element, such as an isolator and a circulator, for use in microwave bands, to a method for manufacturing the non-reciprocal circuit element, and to a communication device.

2. Description of the Related Art

Non-reciprocal circuit elements, such as isolators and circulators, have a characteristic that allows a signal to be transmitted only in a predetermined direction but not in the opposite direction. For example, by utilizing this characteristic, isolators can be used in transmitting circuits of mobile communication devices, such as automobile telephones and portable telephones.

Japanese Unexamined Patent Application Publication No. 2005-20195 (Patent Document 1) discloses a non-reciprocal circuit element, which is provided with a permanent magnet having outer peripheral dimensions that are greater than those of a center-electrode-attached ferrite so that a direct-current magnetic field is distributed uniformly over an entire region of the ferrite.

However, if non-reciprocal circuit elements of this type are to be manufactured by cutting out ferrite-magnet assemblies from a mother substrate, this manufacturing process is problematic in that it requires high costs. Specifically, the manufacturing process involves bonding individually manufactured center-electrode-attached ferrites accurately onto a permanent-magnet/mother substrate, and then cutting the workpiece into predetermined dimensions.

SUMMARY OF THE INVENTION

To overcome the problems described above, preferred embodiments of the present invention provide a non-reciprocal circuit element which has low insertion loss and a simplified manufacturing process, a method for manufacturing the non-reciprocal circuit element, and a communication device.

A preferred embodiment of the present invention provides a non-reciprocal circuit element which includes permanent magnets, a ferrite that receives a direct-current magnetic field from the permanent magnets, a plurality of center electrodes disposed on the ferrite, and a circuit substrate having a terminal electrode on a surface thereof. The center electrodes include a first center electrode and a second center electrode defined by conducting films, the first and second center electrodes being insulated from each other and intersecting each other, the first center electrode having one end electrically connected to a first input-output port and the other end electrically connected to a second input-output port, the second center electrode having one end electrically connected to the second input-output port and the other end electrically connected to a third ground port. The permanent magnets have front and back substantially rectangular principal surfaces, and the ferrite has front and back substantially rectangular principal surfaces, the principal surfaces having substantially the same dimensions, the principal surfaces of the permanent magnets being arranged to face the principal surfaces of the ferrite such that outlines of the permanent magnets and an outline of the ferrite coincide with each other. The ferrite has side surfaces that are substantially perpendicular to the principal surfaces thereof, the side surfaces being provided with recesses.

In the non-reciprocal circuit element according to this preferred embodiment of the present invention, the center electrodes include the first center electrode having one end electrically connected to the first input-output port and the other end electrically connected to the second input-output port, and the second center electrode having one end electrically connected to the second input-output port and the other end electrically connected to the third ground port. Accordingly, a two-port lumped-constant isolator having low insertion loss is provided.

In addition, the permanent magnets have front and back substantially rectangular principal surfaces, and the ferrite has front and back substantially rectangular principal surfaces, the principal surfaces preferably having substantially the same dimensions, the principal surfaces of the permanent magnets being arranged to face the principal surfaces of the ferrite such that the outlines of the permanent magnets and the outline of the ferrite coincide with each other. Thus, a ferrite-magnet assembly can be manufactured by laminating together mother magnet substrates and a center-electrode-attached mother ferrite substrate, and then integrally cutting the laminate. This reduces the manufacturing cost.

When the outline dimensions of the permanent magnets are substantially the same as the outline dimensions of the ferrite, the direct-current bias magnetic field applied from the permanent magnets is typically weaker in the peripheral areas of the principal surfaces of the ferrite, which face the peripheral areas of the principal surfaces of the permanent magnets. However, in the non-reciprocal circuit element according to preferred embodiments of the present invention, the side surfaces of the ferrite that are substantially perpendicular to the principal surfaces thereof (i.e. the peripheral areas of the principal surfaces of the ferrite where the direct-current bias magnetic field is weaker) are provided with the recesses so that the ferrite itself is reduced. Thus, the amount of ferrite operating under a low direct-current bias magnetic field is reduced, thereby reducing losses of high frequency magnetic flux. In other words, an insertion loss in the isolator is further reduced. In addition, the ferrite is magnetic although the direct-current relative magnetic permeability is low, whereas the recesses are of a non-magnetic material, such as Ag and Pd, even with conductors provided therein. Thus, a direct-current magnetic flux passing through the peripheral areas of the ferrite is concentrated in regions other than the recesses. Accordingly, this reduces the weakening of the application of the direct-current bias magnetic field and provides for an improved distribution of the direct-current bias magnetic field. In other words, the regions in which the recesses are provided exhibit an effect that is equivalent to when the demagnetization factors are locally reduced in the ferrite, whereby the distribution of direct-current bias magnetic field is improved. As a result, an insertion loss in the isolator is further reduced.

In the non-reciprocal circuit element according to preferred embodiments of the present invention, the recesses are preferably provided with intermediate-electrode conductors for electrically connecting the conducting films defining the first center electrode and/or the second center electrode provided on opposite principal surfaces of the ferrite. Furthermore, the recesses are preferably provided with connector-electrode conductors for electrically connecting the first and second center electrodes to the terminal electrode on the circuit substrate. If the conductors are to be provided in the recesses in this manner, it is preferable that the second center electrode be wound around the ferrite through the opposite principal surfaces and opposite longitudinal side surfaces thereof by one or more turns, and that the first center electrode be wound around the ferrite through the opposite principal surfaces and the opposite longitudinal side surfaces thereof by one or more turns so as to intersect the second center electrode at a predetermined angle. In this case, the conductors in the recesses are preferably provided only in the longitudinal side surfaces of the ferrite, and the ferrite and the permanent magnets are preferably disposed on the circuit substrate such that the principal surfaces thereof face each other and extend in a direction that is substantially perpendicular to the surface of the circuit substrate.

In the non-reciprocal circuit element described above, a high frequency magnetic flux that is distant from an area surrounded by the second center electrode is guided towards the central portion of the ferrite without passing through the recesses having the conductors therein. This means that a large number of high frequency magnetic fluxes pass through the central portion of the ferrite. Since a sufficient direct-current bias magnetic field is applied to the central portion of the ferrite, a loss of high frequency magnetic flux is low. As a result, an insertion loss in the isolator is further reduced.

Furthermore, the longitudinal side surfaces of the ferrite are preferably provided with dummy recesses in addition to the recesses. These dummy recesses may have conductors provided therein. This advantageously produces an improved distribution of direct-current bias magnetic field in the peripheral areas of the principal surfaces of the ferrite, and less losses of high frequency magnetic flux. Moreover, the dummy recesses may have dielectrics embedded therein. Thus, the longitudinal side surfaces of the ferrite can be made flat.

The recesses and the dummy recesses may be arranged over substantially the entire lengths of the opposite longitudinal side surfaces of the ferrite at regular intervals. The dummy recesses may each be wider than each of the recesses so as to further reduce the amount of high-loss ferrite material.

Another preferred embodiment of the present invention also provides a method for manufacturing a non-reciprocal circuit element including permanent magnets, a ferrite that receives a direct-current magnetic field from the permanent magnets, a plurality of center electrodes disposed on the ferrite, and a circuit substrate having a terminal electrode on a surface thereof. The method includes forming the plurality of center electrodes in an intersecting manner on front and back principal surfaces of a mother ferrite substrate using conducting films such that the center electrodes are insulated from each other, forming a plurality of through holes extending between the front and back principal surfaces, embedding one or more intermediate conductors into one or more of the through holes so that the one or more intermediate conductors electrically connect the conducting films defining the center electrodes, and embedding one or more connector conductors into one or more of the through holes, the one or more connector conductors being electrically connected to the terminal electrode on the circuit substrate, and forming a laminate by sandwiching the mother ferrite substrate between a pair of mother magnet substrates via adhesive layers, and cutting the laminate into predetermined dimensions along where the through holes are to be cut so as to form a ferrite-magnet assembly having a center-electrode composite sandwiched between a pair of the permanent magnets as a single unit.

The term "through hole" refers to a hole that extends through a substrate from the front to the back of the substrate and that does not yet have a conductor embedded therein or a conducting layer formed therein.

In the manufacturing method according to preferred embodiments of the present invention, a laminate is formed by sandwiching the mother ferrite substrate having the center electrodes and the through holes between the mother magnet substrates via the adhesive layers. The laminate is then cut into predetermined dimensions along where the through holes are to be cut. Consequently, a ferrite-magnet assembly having a center-electrode composite sandwiched between a pair of the permanent magnets as a single unit is obtained. Accordingly, the manufacturing process is significantly simplified and the manufacturing cost is reduced.

The through holes function as recesses, thereby providing an improved distribution of direct-current bias magnetic field and less losses of high frequency magnetic flux. One or more of the through holes may be provided as one or more dummy through holes in which the one or more intermediate conductors or the one or more connector conductors are not embedded. The one or more dummy through holes may have one or more conductors embedded therein or one or more dielectrics embedded therein.

Another preferred embodiment of the present invention provides a communication device including the aforementioned non-reciprocal circuit element. Accordingly, a communication device with low insertion loss and favorable electrical properties is obtained.

According to preferred embodiments of the present invention, the manufacturing process is simplified and the insertion loss is further reduced. In addition, the distribution of a direct-current bias magnetic field applied to the ferrite is improved, and the losses of high frequency magnetic flux are reduced.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a non-reciprocal circuit element, a manufacturing method therefor, and a communication device according to the present invention will be described below with reference to the attached drawings.

Figure 1:
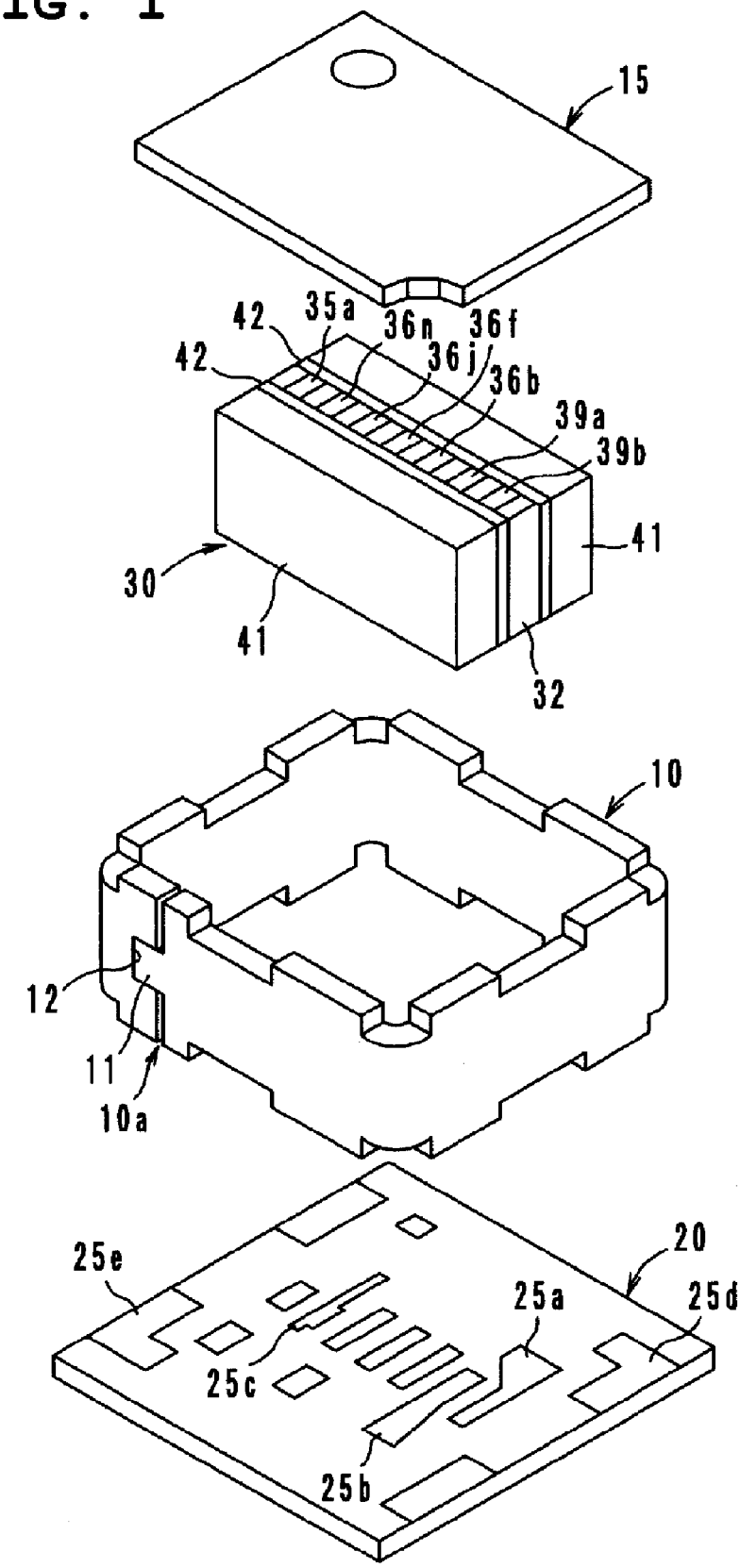
FIG. 1 is an exploded perspective view of a non-reciprocal circuit element (two-port isolator) according to a preferred embodiment of the present invention.

FIG. 1 is an exploded perspective view of a two-port isolator corresponding to a non-reciprocal circuit element according to a preferred embodiment of the invention. The two-port isolator is preferably a lumped-constant isolator that includes a metallic yoke 10, a cap 15, a circuit substrate 20, and a ferrite-magnet assembly 30 constituted by a ferrite 32 and permanent magnets 41.

The yoke 10 is preferably composed of a ferromagnetic material, such as soft iron, and is subjected to an anticorrosive treatment. The yoke 10 is arranged as a frame that surrounds the ferrite-magnet assembly 30 above the circuit substrate 20. The yoke 10 is preferably formed in the following manner, for example. First, a strip is formed by punching. In this state, an engagement portion 10*a* is not engaged and the yoke 10 is still in its unfolded state. A protrusion 11 and a recess 12 are then tightly engaged to each other by so-called crushing so that an annular body is formed.

Upper surfaces of the ferrite 32 and the permanent magnets 41 have the cap 15 bonded thereto, which is composed of a dielectric material (such as resin and ceramics). The cap 15 may alternatively be formed of a soft magnetic metallic plate. The yoke 10 and the cap 15 define a magnetic circuit together with the permanent magnets 41, and are plated with silver over a copper-plated foundation layer to improve the anticorrosive properties and to reduce a conductor loss resulting from an eddy current caused by a high frequency magnetic flux or a conductor loss resulting from a ground current.

Figure 2:
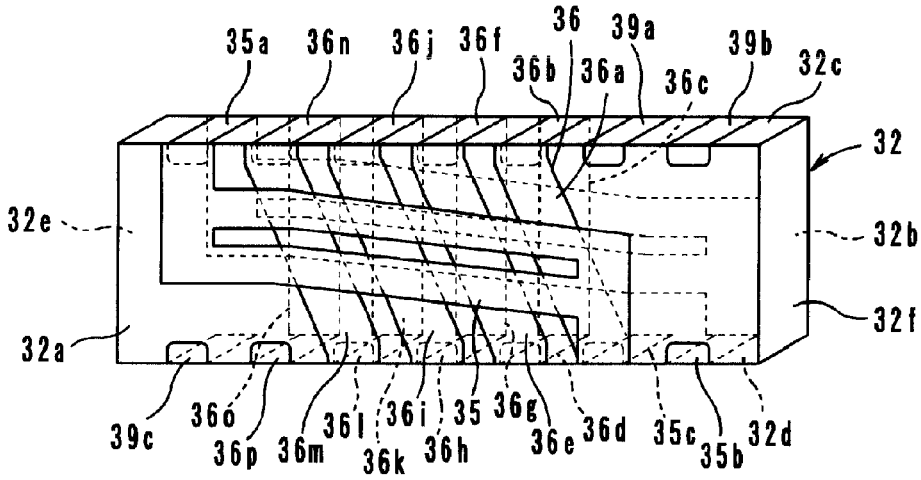
FIG. 2 is a perspective view of a ferrite including center electrodes.

As shown in FIG. 2, the ferrite 32 has first and second principal surfaces 32*a* and 32*b* which are provided with a first center electrode 35 and a second center electrode 36 that are electrically insulated from each other. The ferrite 32 has a substantially rectangular prism shape, which includes the first principal surface 32*a* and the second principal surface 32*b* that are substantially parallel to each other, longitudinal side surfaces 32*c*, 32*d*, and lateral side surfaces 32*e*, 32*f*.

Figure 4:
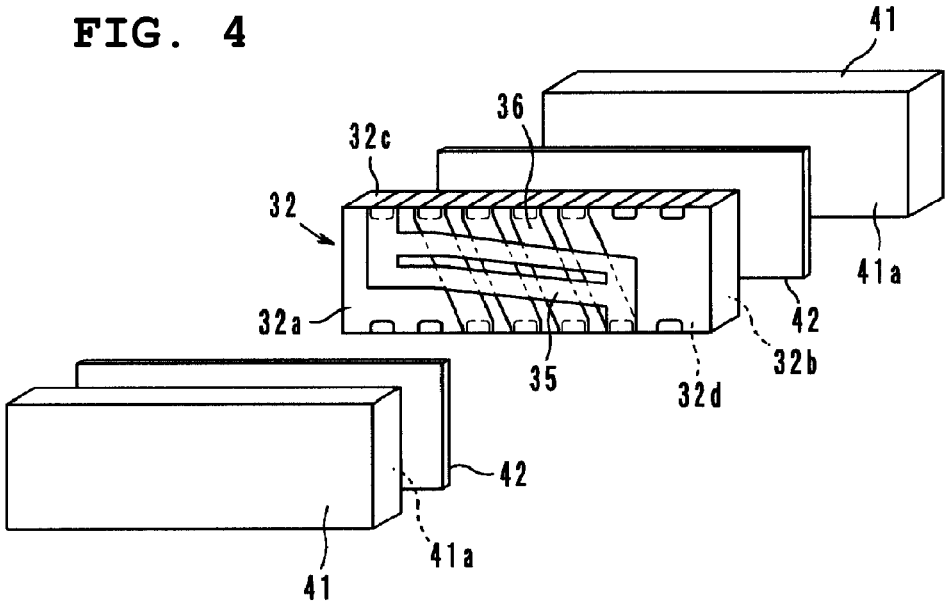
FIG. 4 is an exploded perspective view of a ferrite-magnet assembly.

The permanent magnets 41 are bonded to the respective principal surfaces 32*a*, 32*b* with, for example, epoxy adhesive sheet layers 42 (see FIG. 4) to form the ferrite-magnet assembly 30, such that a magnetic field is applied to the principal surfaces 32*a*, 32*b* of the ferrite 32 in a direction substantially perpendicular to the principal surfaces 32*a*, 32*b*. The permanent magnets 41 have principal surfaces 41*a* that have substantially the same dimensions as the principal surfaces 32*a*, 32*b* of the ferrite 32. The principal surfaces 32*a* and 41*a* are arranged to face each other such that the outlines thereof coincide with each other, and similarly, the principal surfaces 32*b* and 41*a* are arranged to face each other such that the outlines thereof coincide with each other. A manufacturing process of the ferrite-magnet assembly 30 will be described later in detail with reference to FIG. 11.

As shown in FIG. 2, the first center electrode 35 extends upward from a lower right section of the first principal surface 32*a* of the ferrite 32 and is bifurcated into two segments. The two segments extend in an upper left direction at a relatively small angle with respect to the longitudinal direction. The first center electrode 35 then extends upward to an upper left section and turns toward the second principal surface 32*b* through an intermediate electrode 35*a* on the upper surface 32*c*. On the second principal surface 32*b*, the first center electrode 35 is bifurcated into two segments again so as to overlap with that on the first principal surface 32*a* in the perspective view. One end of the first center electrode 35 is connected to a connector electrode 35*b* provided on the lower surface 32*d*. The other end of the first center electrode 35 is connected to a connector electrode 35*c* provided on the lower surface 32*d*. The first center electrode 35 is thus wound around the ferrite 32 by one turn. The first center electrode 35 and the second center electrode 36, to be described below, have an insulating film therebetween, such that these electrodes intersect each other in an insulated state.

The second center electrode 36 has a 0.5 th-turn segment 36*a* that extends in the upper left direction from a substantially midsection of the lower edge of the first principal surface 32*a* at a relatively large angle with respect to the longitudinal direction and intersects the first center electrode 35. The 0.5 th-turn segment 36*a* makes a turn towards the second principal surface 32*b* through an intermediate electrode 36*b* on the upper surface 32*c* so as to connect to a 1 st-turn segment 36*c*. On the second principal surface 32*b*, the 1 st-turn segment 36*c* intersects the first center electrode 35 in a substantially perpendicular fashion. A lower end portion of the 1 st-turn segment 36*c* makes a turn towards the first principal surface 32*a* through an intermediate electrode 36*d* on the lower surface 32*d* so as to connect to a 1.5 th-turn segment 36*e*. On the first principal surface 32*a*, the 1.5 th-turn segment 36*e* extends substantially parallel to the 0.5 th-turn segment 36*a* and intersects the first center electrode 35. The 1.5 th-turn segment 36*e* turns toward the second principal surface 32*b* through an intermediate electrode 36*f* on the upper surface 32*c*. In a similar manner, a 2 nd-turn segment 36*g*, an intermediate electrode 36*h*, a 2.5 th-turn segment 36*i*, an intermediate electrode 36*j*, a 3 rd-turn segment 36*k*, an intermediate electrode 361, a 3.5 th-turn segment 36*m*, an intermediate electrode 36*n*, and a 4 th-turn segment 36*o* are provided on the corresponding surfaces of the ferrite 32. The opposite ends of the second center electrode 36 are respectively connected to connector electrodes 35*c* and 36*p* provided on the lower surface 32*d* of the ferrite 32. The connector electrode 35*c* is commonly used between the ends of the first center electrode 35 and the second center electrode 36.

In other words, the second center electrode 36 is helically wound around the ferrite 32 by four turns. The number of turns is calculated based on the fact that one crossing of the center electrode 36 across the first principal surface 32*a* or the second principal surface 32*b* equals a 0.5 turn. The intersecting angle between the center electrodes 35, 36 is set so as to adjust the input impedance and insertion loss.

The first and second center electrodes 35, 36 can be modified into various shapes. For example, although the first center electrode 35 in this preferred embodiment is bifurcated into two segments on each of the principal surfaces 32*a*, 32*b* of the ferrite 32, the first center electrode 35 does not necessarily need to be bifurcated.

Figure 3:
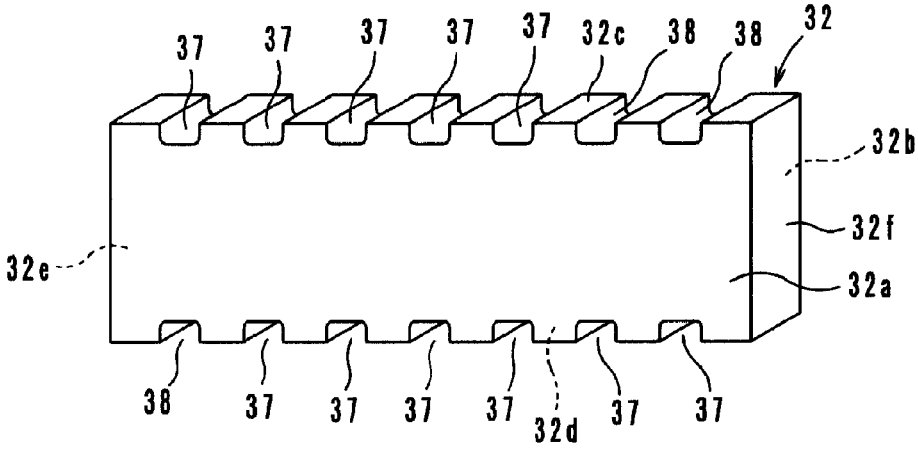
FIG. 3 is a perspective view of the ferrite.

The connector electrodes 35*b*, 35*c*, 36*p* and the intermediate electrodes 35*a*, 36*b*, 36*d*, 36*f*, 36*h*, 36*j*, 361, 36*n* are formed by embedding electrode conductors into corresponding recesses 37 (see FIG. 3) provided on the upper and lower surfaces 32*c*, 32*d* of the ferrite 32. In addition, the upper and lower surfaces 32*c*, 32*d* have dummy recesses 38 provided substantially in parallel to the electrodes, and are also provided with dummy electrodes 39*a*, 39*b*, 39*c*. These electrodes are formed by preliminarily forming through holes in a mother ferrite substrate, embedding electrode conductors into these through holes, and then cutting the substrate along where the through holes are to be cut. This manufacturing method will be described later. These various electrodes may alternatively be formed as a conducting film in the recesses 37, 38.

As a ferrite 32, a YIG ferrite may be used. Alternatively, other suitable ferrite materials may be used for the ferrite 32. The first and second center electrodes 35, 36 and the other various electrodes are each formed as a thick film composed of silver or a silver alloy by, for example, printing, transferring, or photolithography. The insulating film between the center electrodes 35 and 36 may be defined by a thick glass dielectric film.

Strontium, barium, or lanthanum-cobalt ferrite magnets are typically used as the permanent magnets 41. In contrast to a metallic magnet functioning as a conductor, a ferrite magnet is also a dielectric, such that a high frequency magnetic flux can be distributed within the magnet without loss. For this reason, even if the permanent magnets 41 are disposed close to the center electrodes 35, 36, deterioration of electrical properties, including an insertion loss, is substantially prevented. Moreover, the temperature characteristics in the saturation magnetization of the ferrite 32 and the temperature characteristics in the magnetic flux density of the permanent magnets 41 are similar. Therefore, with the isolator being defined by a combination of the ferrite 32 and the permanent magnets 41, the temperature-dependent electrical properties of the isolator are satisfactory.

Figure 5:
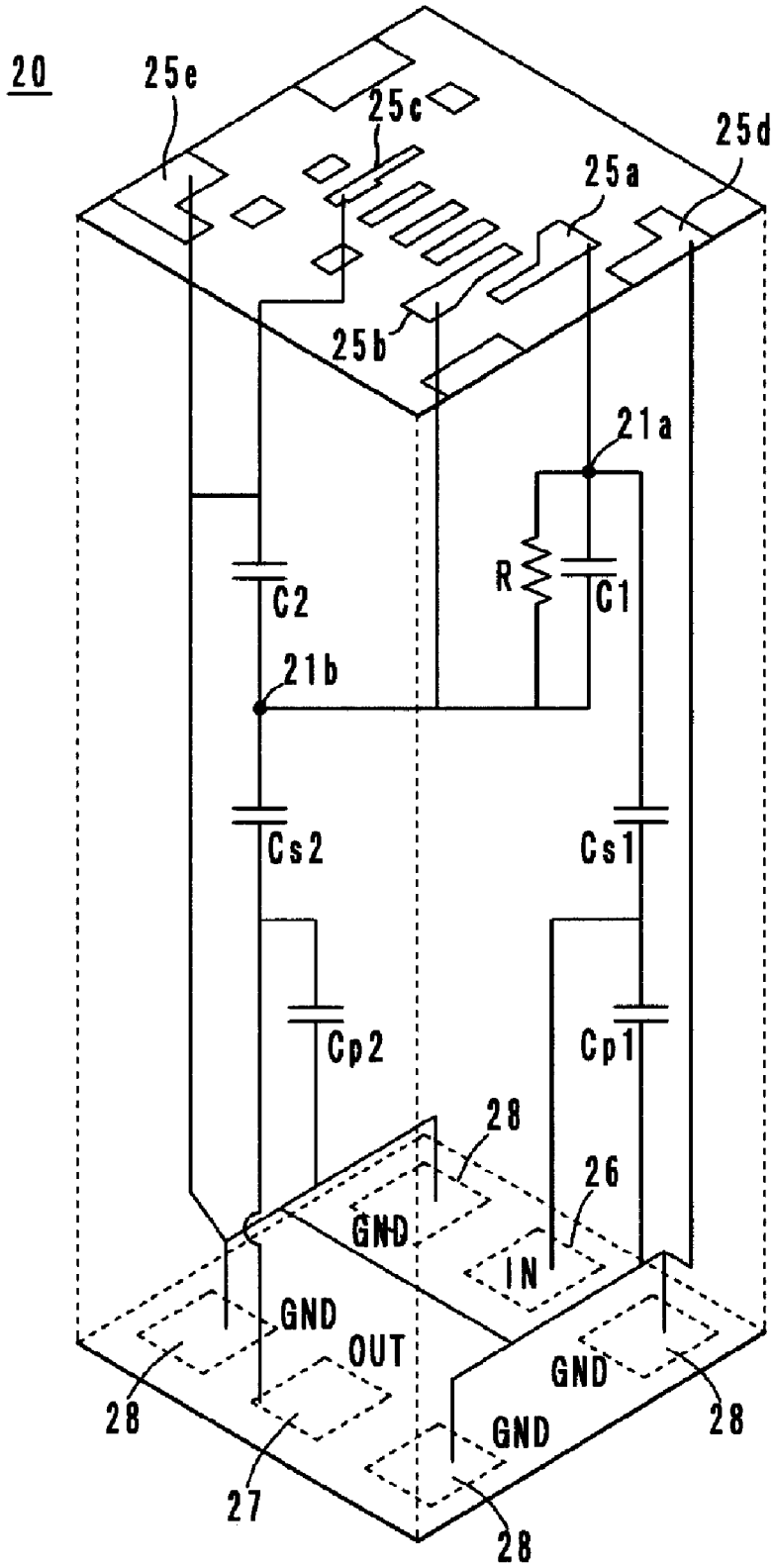
FIG. 5 is a block diagram showing a circuit configuration in a circuit substrate.

The circuit substrate 20 is a sintered multilayer substrate having predetermined electrodes provided on a plurality of dielectric sheets. As shown in FIG. 5, the circuit substrate 20 includes matching capacitors C1, C2, Cs1, Cs2, Cp1, Cp2 and a terminating resistor R. The circuit substrate 20 also includes terminal electrodes 25*a* to 25*e* on the top surface thereof and external-connection terminal electrodes 26, 27, 28 on the bottom surface thereof.

Figure 6:
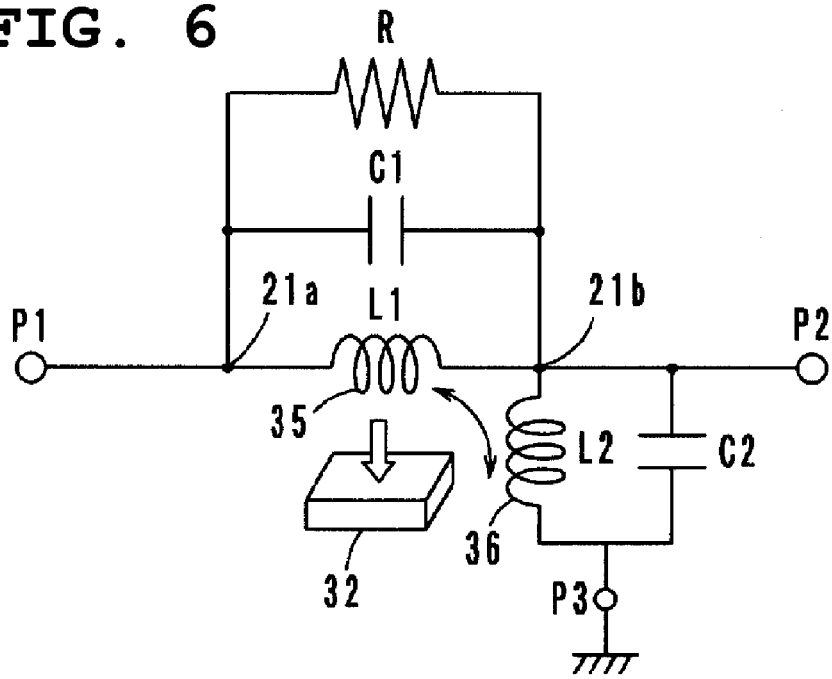
FIG. 6 is an equivalent circuit diagram showing a first circuit example of the two-port isolator.
Figure 7:
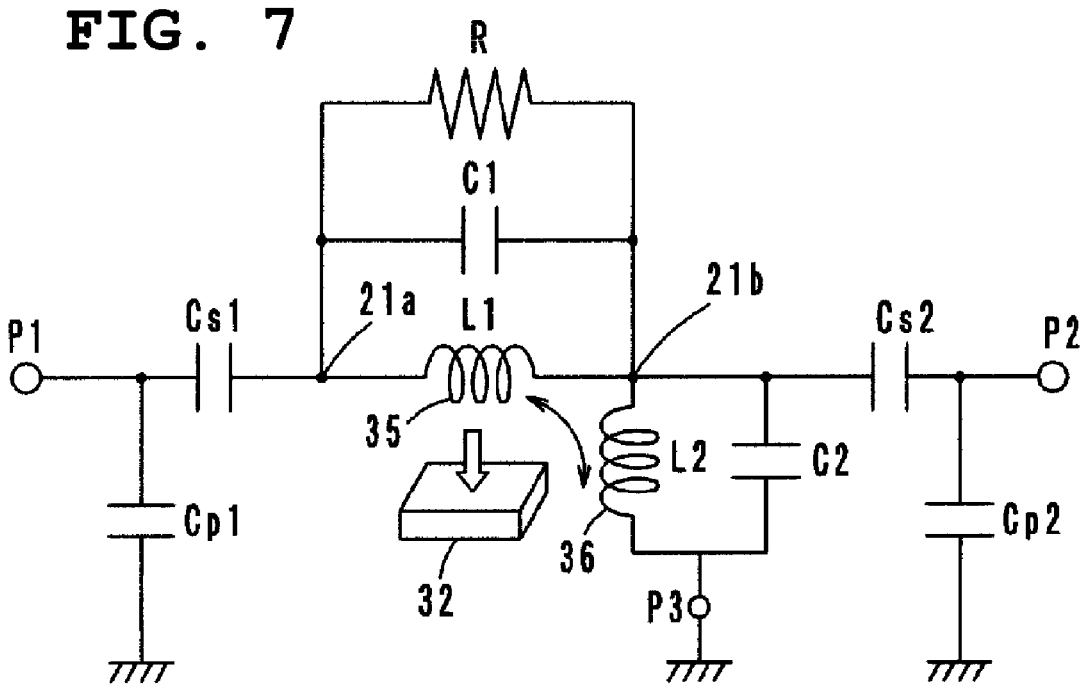
FIG. 7 is an equivalent circuit diagram showing a second circuit example of the two-port isolator.

The connection relationships among these matching circuit components and the first and second center electrodes 35, 36 will be described with reference to equivalent circuit diagrams shown in FIGS. 5, 6, and 7. The equivalent circuit diagram in FIG. 6 shows a first basic circuit example in the non-reciprocal circuit element (two-port isolator) according to a preferred embodiment of the present invention. The equivalent circuit diagram in FIG. 7 shows a second circuit example. FIG. 5 illustrates the configuration of the second circuit example in FIG. 7.

Specifically, the external-connection terminal electrode 26 provided on the bottom surface of the circuit substrate 20 functions as an input port Pl. This terminal electrode 26 is connected to a connection point 21*a* between the matching capacitor C1 and the terminating resistor R via the matching capacitor Cs1. The connection point 21*a* is connected to the one end of the first center electrode 35 via the terminal electrode 25*a* provided on the top surface of the circuit substrate 20 and the connector electrode 35*b* provided on the lower surface 32*d* of the ferrite 32.

The other end of the first center electrode 35 and the one end of the second center electrode 36 are connected to the terminating resistor R and the matching capacitors C1, C2 via the connector electrode 35*c* provided on the lower surface 32*d* of the ferrite 32 and the terminal electrode 25*b* provided on the top surface of the circuit substrate 20.

On the other hand, the external-connection terminal electrode 27 provided on the bottom surface of the circuit substrate 20 functions as an output port P2. This electrode 27 is connected to a connection point 21*b* between the matching capacitors C2, C1 and the terminating resistor R via the matching capacitor Cs2.

The other end of the second center electrode 36 is connected to the capacitor C2 and to the external-connection terminal electrodes 28 provided on the bottom surface of the circuit substrate 20 via the connector electrode 36*p* provided on the lower surface 32*d* of the ferrite 32 and the terminal electrode 25*c* provided on the top surface of the circuit substrate 20. The external-connection terminal electrodes 28 function as a ground port P3. Furthermore, the external-connection terminal electrodes 28 are also connected to the yoke 10 via the terminal electrodes 25*d*, 25*e* provided on the top surface of the circuit substrate 20.

A connection point between the input port P1 and the capacitor Cs1 is connected to an impedance-adjusting capacitor Cp1 that is connected to ground. Likewise, a connection point between the output port P2 and the capacitor Cs2 is connected to an impedance-adjusting capacitor Cp2 that is connected to ground.

The circuit substrate 20 and the yoke 10 are combined with each other by soldering them together through the terminal electrodes 25*d*, 25*e* and other dummy electrodes. The electrodes on the lower surface 32*d* of the ferrite 32 in the ferrite-magnet assembly 30 are bonded to the terminal electrodes 25*a*, 25*b*, 25*c* and other dummy terminal electrodes on the circuit substrate 20 by soldering, and the lower surfaces of the permanent magnets 41 are bonded on the circuit substrate 20 with an adhesive. A one-part or two-part epoxy adhesive of a thermosetting type is suitable for this adhesive. In other words, using both solder and adhesive for the bonding between the ferrite-magnet assembly 30 and the circuit substrate 20 ensures a secure connection.

The circuit substrate 20 may be a substrate formed by firing a mixture of glass and alumina or other dielectric materials or may be a composite substrate composed of resin or glass and other dielectric materials. The internal and external electrodes may each be formed of, for example, a thick film composed of silver or a silver alloy, a thick film composed of copper, or a copper foil. In particular, the external-connection terminal electrodes are preferably plated with gold over a nickel-plated layer. This is to improve the anticorrosive properties and the resistance to solder leaching, and to prevent the strength of the soldered sections from being reduced due to various causes.

In the two-port isolator described above, one end of the first center electrode 35 is connected to the input port P1 and the other end thereof is connected to the output port P2, and one end of the second center electrode 36 is connected to the output port P2 and the other end thereof is connected to the ground port P3. Consequently, a two-port lumped-constant isolator with a low insertion loss is provided. Moreover, when the isolator is in operation, a large magnitude of high frequency current flows into the second center electrode 36, whereas very little high frequency current flows into the first center electrode 35. Accordingly, the direction of high frequency magnetic field produced by the first center electrode 35 and the second center electrode 36 is determined based on the position of the second center electrode 36. The determination of the direction of high frequency magnetic field facilitates the measures for further reducing an insertion loss.

The permanent magnets 41 have front and back rectangular principal surfaces 41*a*, and the ferrite 32 has front and back substantially rectangular principal surfaces 32*a*, 32*b*, the principal surfaces 32*a*, 32*b*, 41*a* having substantially the same dimensions. The principal surfaces 32*a* and 41*a* are arranged to face each other such that the outlines thereof coincide with each other, and similarly, the principal surfaces 32*b* and 41*a* are arranged to face each other such that the outlines thereof coincide with each other. Therefore, as will be described later with reference to FIG. 11, the ferrite-magnet assemblies 30 can be manufactured by laminating together mother magnet substrates and a center-electrode-attached mother ferrite substrate and then integrally cutting the laminate. This reduces the manufacturing cost. The principal surfaces 32*a*, 32*b*, 41*a* are arranged substantially vertically on the circuit substrate 20 in a direction that is substantially perpendicular to the surface of the circuit substrate 20. Moreover, the side surfaces of the permanent magnets 41 and the ferrite 32, namely, the surfaces mounted to the circuit substrate 20 are flush with each other. Consequently, this improves the reliability of the connection with the terminal electrodes on the circuit substrate 20. In addition, even if the permanent magnets 41 are made thicker to obtain a large magnetic field, the height will not be increased regardless of the thickness.

Figure 8:
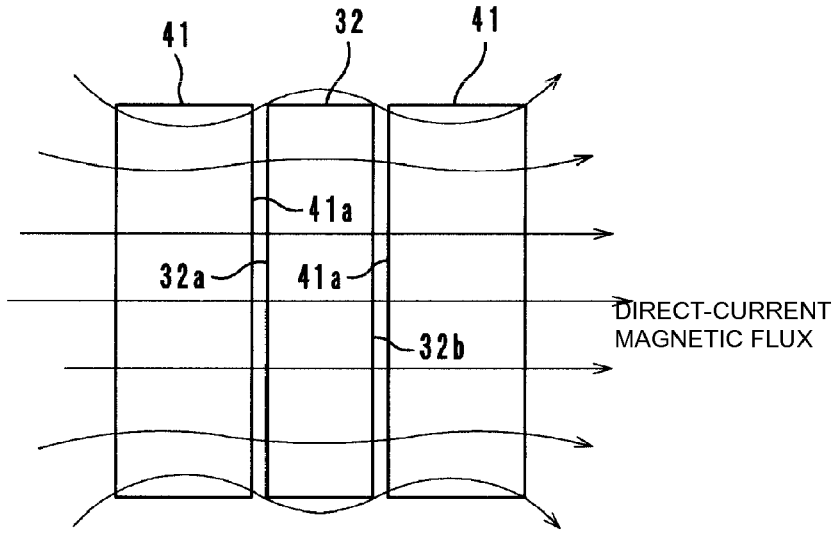
FIG. 8 illustrates a direct-current magnetic flux in the ferrite-magnet assembly as viewed transparently.

When the outline dimensions of the permanent magnets 41 are substantially the same as the outline dimensions of the ferrite 32 as shown in FIG. 8, the direct-current bias magnetic field applied from the permanent magnets 41 is generally weaker in the peripheral areas of the principal surfaces 32*a*, 32*b* of the ferrite 32, which face the peripheral areas of the principal surfaces 41*a* of the permanent magnets 41. However, in the isolator according to a preferred embodiment of the present invention, the side surfaces 32*c*, 32*d* that are substantially perpendicular to the principal surfaces 32*a*, 32*b* of the ferrite 32 (i.e. the peripheral areas of the principal surfaces 32*a*, 32*b* of the ferrite 32 where the direct-current bias magnetic field is weaker) are provided with the recesses 37, 38 so that the ferrite 32 itself is reduced. This inhibits the direct-current bias magnetic field from weakening and enables less losses of high frequency magnetic flux. In other words, an insertion loss in the isolator is further reduced. In addition, the ferrite 32 is magnetic although the direct-current relative magnetic permeability is low, whereas the recesses 37, 38 are non-magnetic even with the conductors provided therein. Thus, a direct-current magnetic flux passing through the recesses 37, 38 has a tendency to concentrate in regions other than the recesses. Accordingly, this prevents the weakening of application of the direct-current bias magnetic field and enables an improved distribution of the direct-current bias magnetic field. In other words, the regions at which the recesses 37, 38 are provided exhibit an effect that is equivalent to a case in which the demagnetization factors are locally reduced in the ferrite 32. As a result, an insertion loss in the isolator is further reduced. This effect can similarly occur in a case in which conductors are not provided in the recesses 37, 38.

The conductors in the recesses 37, 38 are provided only on the longitudinal side surfaces 32*c*, 32*d* of the ferrite 32. The lateral side surfaces 32*e*, 32*f* are surfaces through which a high frequency magnetic flux that is substantially perpendicular to the second center electrode 36 passes. A high frequency magnetic flux is allowed to pass without being inhibited as long as there are no conductors provided in these side surfaces 32*e*, 32*f*. However, providing the conductors on the side surfaces 32*e*, 32*f* will not be problematic as long as the conductors are in the corner regions of the side surfaces 32*e*, 32*f*. In that case, a high frequency magnetic flux is allowed to pass without substantially being inhibited.

Figure 10:
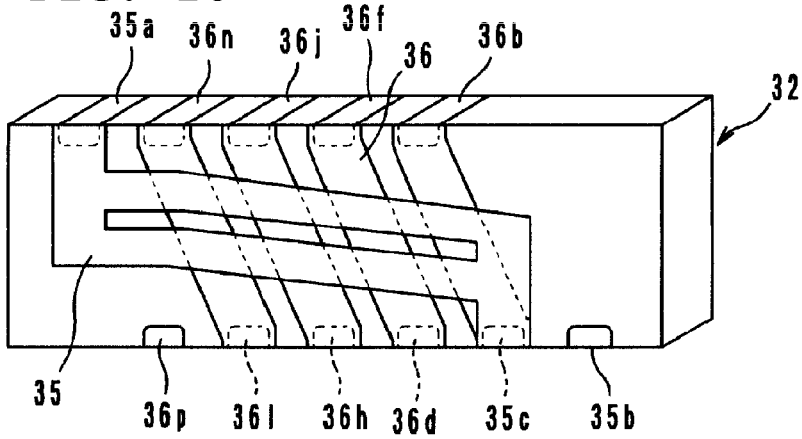
FIG. 10 is a perspective view showing another example of the center-electrode-attached ferrite.

The dummy recesses 38 are not necessarily required. FIG. 10 shows a center-electrode-attached ferrite 32 in which the dummy recesses 38 are omitted.

Figure 9:
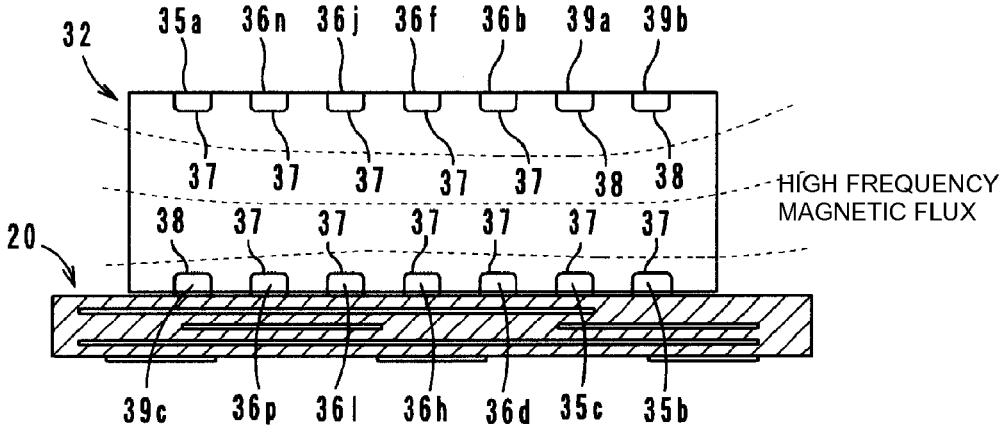
FIG. 9 illustrates a high frequency magnetic flux in the ferrite as viewed transparently.

A high frequency magnetic flux that is distant from an area surrounded by the second center electrode 36 generally begins to immediately spread, causing multiple high frequency magnetic fluxes to diffuse from the ferrite 32. In contrast, in the isolator according to preferred embodiments of the present invention, since the intermediate electrodes and connector electrodes are provided in the recesses 37, 38, the high frequency magnetic flux is guided towards the central portion of the ferrite 32 without passing through the recesses 37, 38 having the conductors therein, as shown in FIG. 9. This means that a large number of high frequency magnetic fluxes pass through the central portion of the ferrite 32. Since a sufficient direct-current bias magnetic field is applied to the central portion of the ferrite 32, a loss of high frequency magnetic flux is low. As a result, an insertion loss in the isolator is further reduced.

Since conductors are embedded in the dummy recesses 38 provided in the longitudinal side surfaces 32*c*, 32*d* of the ferrite 32, the aforementioned advantage significantly contributes to an improved distribution of direct-current bias magnetic field in the peripheral areas of the principal surfaces 32*a*, 32*b* of the ferrite 32 and to less losses of high frequency magnetic flux. As an alternative to embedding conductors in the recesses 37 and the dummy recesses 38, conducting films may be formed by thick film processing or thin film processing. Furthermore, the dummy recesses 38 may have dielectrics material embedded therein. Thus, the longitudinal side surfaces 32*c*, 32*d* of the ferrite 32 can be made flat. Furthermore, the dummy recesses 38 may be wider than the recesses 37 so as to further reduce the amount of high-loss ferrite material.

It is possible to prevent the insertion loss from increasing by configuring the principal surfaces 41*a* of the permanent magnets 41 to have a size greater than the principal surfaces 32*a*, 32*b* of the ferrite 32. However, this not only reduces the advantage of being able to cut the mother magnet substrates and the mother ferrite substrate simultaneously in the manufacturing process, but also leads to an increased surface area of the permanent magnets 41. Thus, when the ferrite-magnet assembly 30 is disposed vertically on the circuit substrate 20, the isolator has an increased height, and the lower surface 32*d* of the ferrite 32 is in a raised state from the front surface of the circuit substrate 20. This makes the connection between the various electrodes and the terminal electrodes more difficult, resulting in reduced connection reliability.

Furthermore, in the isolator according to preferred embodiments of the present invention, the first center electrode 35 is wound by one turn and the second center electrode 36 is wound by four turns, whereby favorable insertion loss is obtained over a wide band. In other words, by winding the first and second center electrodes 35, 36 around the ferrite 32, the number of intersections between the center electrodes 35, 36 increases, and the coupling coefficient between the center electrodes 35, 36 is increased. This enables less insertion loss and a wider band for the passing frequency.

Furthermore, as shown in the second circuit example (see FIG. 7), the matching capacitor Cs1 is interposed between the input port P1 and the connection point 21*a* of the first center electrode 35 and the matching capacitor C1, and the matching capacitor Cs2 is interposed between the output port P2 and the connection point 21*b* of the center electrodes 35, 36. Thus, when the inductance of the center electrodes 35, 36 is set at a large value and the electrical properties in a wide band are improved, the impedance (about 50Ω) with respect to a device connected to the isolator can be adjusted. This advantage can be similarly achieved by including only one of the matching capacitors Cs1 and Cs2.

By incorporating a matching inductor between the ground port P3 and a connection point of the second center electrode 36 and the capacitor C2, a predetermined high frequency wave, such as a second or third harmonic wave, is suppressed.

Furthermore, LC series circuits defined by inductors and capacitors may be incorporated between the input port P1 and the ground and between the output port P2 and the ground. By providing these LC series circuits, a predetermined high frequency wave, such as a second or third harmonic wave, is similarly suppressed.

The ferrite 32 and the pair of permanent magnets 41 are combined with each other via the adhesive sheet layers 42. Thus, the isolator is mechanically stable and has a rigid structure that is prevented from becoming deformed or broken in response to vibration or shock. This isolator is suitable for a portable communication device. Instead of using the adhesive sheet layers 42 for combining the ferrite 32 and the permanent magnets 41, other various alternatives can be used. One alternative example is to apply an adhesive agent.

Since the center electrodes 35, 36 are formed as conducting films on the principal surfaces 32*a*, 32*b* of the ferrite 32, these electrodes are formed with stability and high precision, thereby enabling mass production of the isolators having uniform electrical properties. In addition, by using a film of sintered glass powder for the insulating film between the center electrodes 35 and 36, the principal surfaces 32*a*, 32*b* of the ferrite 32 can have a high degree of flatness as compared to when the center electrodes are formed of metal sheets. As a result, the ferrite 32 and the pair of permanent magnets 41 can be combined with a high degree of parallelism with respect to the positional relationship therebetween.

In the isolator according to preferred embodiments of the present invention, the circuit substrate 20 is a multilayer dielectric substrate. Thus, circuitry including capacitors and inductors can be contained within the substrate, so that a compact and low-profile structure of the isolator is achieved. Moreover, the circuit components are connected to each other within the substrate, thereby improving the reliability. The circuit substrate 20 does not necessarily need to be a multilayer structure, and may alternatively be in the form of a single-layer structure. In that case, the circuit substrate 20 may have chip-type capacitors externally attached thereto.

A manufacturing process of the ferrite-magnet assembly 30 will now be described. When manufacturing the ferrite-magnet assembly 30, the center electrodes 35, 36 are formed on front and back surfaces of a mother ferrite substrate using conducting layers, such that these electrodes are insulated from each other and intersect each other. Moreover, a plurality of through holes extending between the front and back surfaces is formed. An intermediate electrode material and a connector electrode material are embedded in the corresponding through holes.

Subsequently, a laminate is formed by sandwiching the mother ferrite substrate between a pair of mother magnet substrates via an adhesive. The laminate is cut into predetermined dimensions along where the through holes are to be cut. As a result, a ferrite-magnet assembly 30 having the center-electrode-attached ferrite 32 sandwiched between a pair of permanent magnets 41 as a single unit is obtained.

Figure 11:
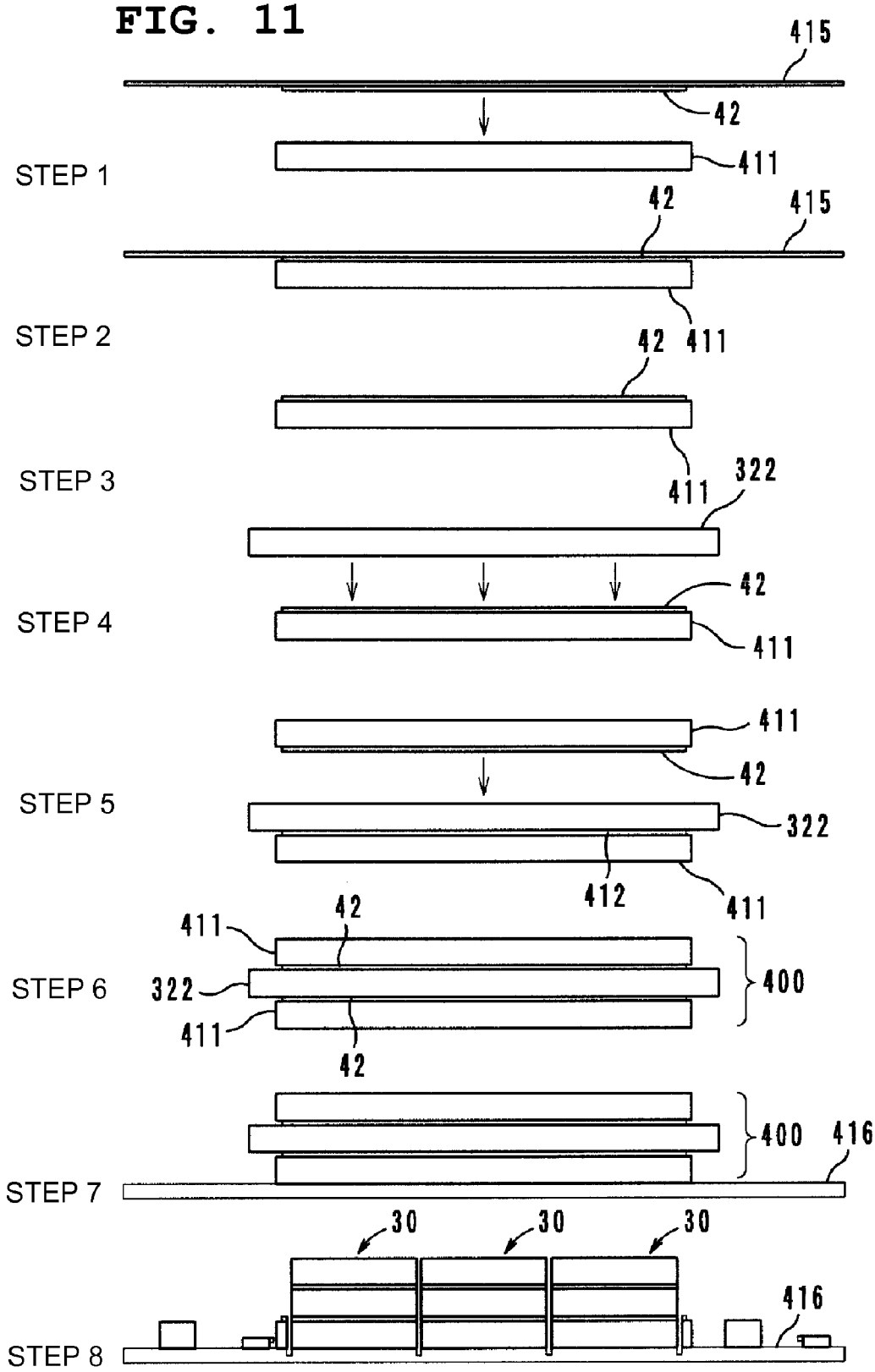
FIG. 11 illustrates steps included in a manufacturing method according to a preferred embodiment of the present invention.

FIG. 11 illustrates the process. In steps 1, 2, and 3, an adhesive sheet layer 42 having a separator 415 attached thereto is bonded to a mother magnet substrate 411. The separator 415 is then peeled off. In step 4, a mother ferrite substrate 322 (having center electrodes and through holes) is hermetically bonded on the mother magnet substrate 411 via the adhesive sheet 42. In steps 5 and 6, another mother magnet substrate 411 having an adhesive sheet layer 42 is hermetically bonded onto the mother ferrite substrate 322. As a result, a laminate 400 is obtained.

In step 7, the laminate 400 is bonded onto a dicing tape 416. In step 8, using a dicer, the laminate 400 is cut into predetermined dimensions along where the through holes are to be cut, whereby a plurality of ferrite-magnet assemblies 30 is obtained, each being a single unit.

According to the aforementioned steps, the ferrite-magnet assemblies 30, each including the permanent magnets 41 of substantially the same size that sandwich the ferrite 32 of the same size therebetween, can be manufactured efficiently with high precision, thereby significantly reducing the cost. The advantages of these ferrite-magnet assemblies 30 have been described above.

In particular, because the mother magnet substrates 411 and the mother ferrite substrate 322 having large surface areas are used, the degree of parallelism among the permanent magnets 41 and the ferrite 32 is improved as compared to a case in which the permanent magnets 41 and the ferrite 32 are individually bonded together. Thus, the parallelism and uniformity of a bias magnetic field applied to the ferrite 32 are assured, thereby preventing deterioration of electrical properties, such as an insertion loss. In addition, displacement of the ferrite 32 is prevented from occurring. This not only prevents individual differences among the isolators, but also provides highly reliable isolators with reduced time/age deterioration.

Figure 12:
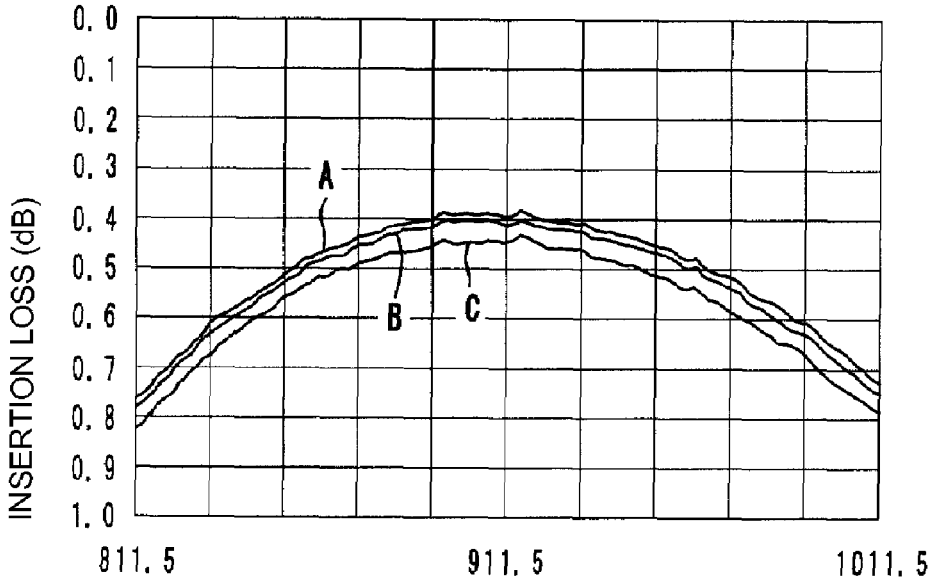
FIG. 12 is a graph showing insertion-loss characteristics of the non-reciprocal circuit element according to a preferred embodiment of the present invention.

FIG. 12 shows electrical properties of isolators in accordance with configurations of the ferrite-magnet assembly 30. Each of the isolators measured for electrical properties includes the ferrite-magnet assembly 30. Specifically, with regard to the principal surfaces of the ferrite 32 and the permanent magnets 41, the longitudinal sides preferably have a length of about 2.0 mm and the lateral sides have a length of about 0.60 mm, for example. The ferrite 32 has a thickness of about 0.125 mm. The permanent magnets 41 have a thickness of about 0.35 mm.

In FIG. 12, a curve line A shows insertion-loss characteristics of an isolator equipped with a ferrite-magnet assembly 30 having conductors embedded in the dummy recesses 38.

When the permanent magnets 41 are replaced with permanent magnets whose principal surfaces have 2.4 -mm longitudinal sides and 0.90 -mm lateral sides and whose thickness is 0.35 mm such that these permanent magnets have a greater surface area than the ferrite 32, the insertion-loss characteristics are substantially the same as the insertion-loss characteristics shown with the curve line A. However, this unfavorably causes the height of the isolator to be increased by about 0.3 mm. In other words, the insertion-loss characteristics obtainable with the aforementioned ferrite-magnet assembly 30 are equivalent to the insertion-loss characteristics obtained when using permanent magnets 41 that have a size greater than the ferrite 32.

A curve line B shows insertion-loss characteristics of an isolator equipped with a ferrite-magnet assembly 30 having dielectrics (glass) embedded in the dummy recesses. A curve line C shows insertion-loss characteristics of an isolator equipped with a ferrite-magnet assembly 30 having the center-electrode-attached ferrite 32 (see FIG. 10) without the dummy recesses 38.

By comparing the curve lines A, B, and C, it is apparent that the curve line A has the lowest insertion loss. The curve line B is higher than the curve line A by about 0.02 dB, and the curve line C is higher than the curve line A by about 0.05 dB. However, all of these curve lines A, B, and C show favorable electrical properties.

A portable telephone will now be described as an example of a communication device according to preferred embodiments of the present invention.

Figure 13:
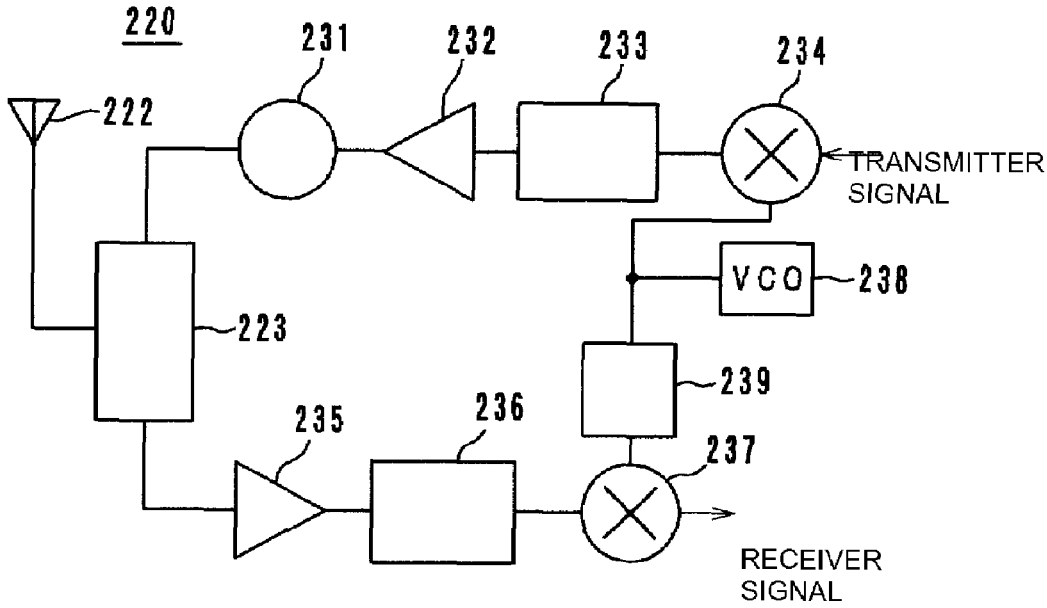
FIG. 13 is a block diagram of a communication device according to a preferred embodiment of the present invention.

FIG. 13 is an electric-circuit block diagram of an RF portion of a portable telephone 220. In FIG. 13, reference numeral 222 denotes an antenna element, reference numeral 223 denotes a duplexer, reference numeral 231 denotes a transmitting-side isolator, reference numeral 232 denotes a transmitting-side amplifier, reference numeral 233 denotes a transmitting-side interstage bandpass filter, reference numeral 234 denotes a transmitting-side mixer, reference numeral 235 denotes a receiving-side amplifier, reference numeral 236 denotes a receiving-side interstage bandpass filter, reference numeral 237 denotes a receiving-side mixer, reference numeral 238 denotes a voltage-controlled oscillator (VCO), and reference numeral 239 denotes a local bandpass filter.

The two-port isolator according to a preferred embodiment described above can be used as the transmitting-side isolator 231. The installation of the isolator enables favorable electrical properties.

The non-reciprocal circuit element, the manufacturing method therefor, and the communication device according to the present invention are not limited to the preferred embodiments described above, and various modifications are permissible within the scope and spirit of the invention.

For example, by inverting the N-pole and the S-pole of the permanent magnets 41, the input port P1 and the output port P2 can be switched. Furthermore, although the matching circuit components are all included in the circuit substrate in the above preferred embodiments, the circuit substrate may alternatively have chip-type inductors or capacitors externally attached thereto.

In the above preferred embodiments, the principal surfaces in the ferrite-magnet assembly are arranged substantially perpendicular to the circuit substrate, or in other words, substantially vertically on the circuit substrate. Alternatively, the principal surfaces may be arranged substantially parallel to the circuit substrate, or in other words, substantially horizontally on the circuit substrate.

Accordingly, the present invention provides a non-reciprocal circuit element, such as an isolator and a circulator, which is particularly advantageous in view of achieving a simplified manufacturing process and a reduced insertion loss.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A non-reciprocal circuit element comprising:

permanent magnets;

a ferrite arranged to receive a direct-current magnetic field from the permanent magnets;

a plurality of center electrodes disposed on the ferrite; and a circuit substrate having a terminal electrode on a surface thereof; wherein the center electrodes include a first center electrode and a second center electrode including conducting films, the first and second center electrodes being insulated from each other and intersecting each other, the first center electrode having one end electrically connected to a first input-output port and the other end electrically connected to a second input-output port, the second center electrode having one end electrically connected to the second input-output port and the other end electrically connected to a third ground port;

the permanent magnets have front and back substantially rectangular principal surfaces, and the ferrite has front and back substantially rectangular principal surfaces, the principal surfaces of the permanent magnets and the ferrite having substantially the same dimensions, the principal surfaces of the permanent magnets being arranged to face the principal surfaces of the ferrite such that outlines of the permanent magnets and an outline of the ferrite coincide with each other; and the ferrite has side surfaces that are substantially perpendicular to the principal surfaces thereof, the side surfaces being provided with recesses.

2. A communication device comprising the non-reciprocal circuit element to claim 1.

3. The non-reciprocal circuit element according to claim 1, wherein the recesses are provided with intermediate-electrode conductors arranged to electrically connect the conducting films defining at least one of the first center electrode or the second center electrode provided on the opposite principal surfaces of the ferrite.

4. The non-reciprocal circuit element according to claim 3, wherein the second center electrode is wound around the ferrite through the opposite principal surfaces and opposite longitudinal side surfaces thereof by at least one turn;

the first center electrode is wound around the ferrite through the opposite principal surfaces and the opposite longitudinal side surfaces thereof by at least one turn so as to intersect the second center electrode at a predetermined angle;

the conductors in the recesses are provided only in the longitudinal side surfaces of the ferrite; and the ferrite and the permanent magnets are disposed on the circuit substrate such that the principal surfaces thereof face each other and extend in a direction substantially perpendicular to the surface of the circuit substrate.

5. The non-reciprocal circuit element according to claim 3, wherein the longitudinal side surfaces of the ferrite are provided with dummy recesses in addition to the recesses.

6. The non-reciprocal circuit element according to claim 5, wherein the dummy recesses have dielectrics embedded therein.

7. The non-reciprocal circuit element according to claim 5, wherein the recesses and the dummy recesses are arranged over substantially the entire lengths of the opposite longitudinal side surfaces of the ferrite at regular intervals.

8. The non-reciprocal circuit element according to claim 5, wherein each of the dummy recesses are wider than each of the recesses.

9. The non-reciprocal circuit element according to claim 5, wherein the dummy recesses have conductors provided therein.

10. The non-reciprocal circuit element according to claim 1, wherein the recesses are provided with connector-electrode conductors for electrically connecting the first and second center electrodes to the terminal electrode on the circuit substrate.

11. The non-reciprocal circuit element according to claim 10, wherein the second center electrode is wound around the ferrite through the opposite principal surfaces and opposite longitudinal side surfaces thereof by at least one turn;

the first center electrode is wound around the ferrite through the opposite principal surfaces and the opposite longitudinal side surfaces thereof by at least one turn so as to intersect the second center electrode at a predetermined angle;

the conductors in the recesses are provided only in the longitudinal side surfaces of the ferrite; and the ferrite and the permanent magnets are disposed on the circuit substrate such that the principal surfaces thereof face each other and extend in a direction substantially perpendicular to the surface of the circuit substrate.

12. The non-reciprocal circuit element according to claim 10, wherein the longitudinal side surfaces of the ferrite are provided with dummy recesses in addition to the recesses.

13. The non-reciprocal circuit element according to claim 12, wherein the dummy recesses have dielectrics embedded therein.

14. The non-reciprocal circuit element according to claim 12, wherein the recesses and the dummy recesses are arranged over substantially the entire lengths of the opposite longitudinal side surfaces of the ferrite at regular intervals.

15. The non-reciprocal circuit element according to claim 12, wherein each of the dummy recesses are wider than each of the recesses.

16. The non-reciprocal circuit element according to claim 12, wherein the dummy recesses have conductors provided therein.

* * * * *